US006652382B1

(12) United States Patent
Karussi et al.

(10) Patent No.: US 6,652,382 B1
(45) Date of Patent: Nov. 25, 2003

(54) HANDHELD GAME SIMULATING COOKIE MAKING ACTIVITY

(75) Inventors: Kurt Karussi, Hermosa Beach, CA (US); Sam Lee, Torrance, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/633,040

(22) Filed: Aug. 4, 2000

(51) Int. Cl.[7] ..... A63F 9/24
(52) U.S. Cl. ..... 463/30; 463/46
(58) Field of Search ..... 463/1, 30–31, 463/35, 36–37, 46, 7, 9; 273/237, 236, 459–461, 148 R, 148 B, 309; 434/307 R, 308, 322, 323, 80, 127–128, 382; 446/481, 479, 148, 147, 150–151

(56) References Cited

U.S. PATENT DOCUMENTS

| | | | |
|---|---|---|---|
| D260,023 | S | 7/1981 | Pagani et al. |
| 4,385,762 | A | 5/1983 | Schwartz |
| 4,536,164 | A | 8/1985 | Klawitter |
| D321,215 | S | 10/1991 | Shamis |
| D333,060 | S | 2/1993 | Perego |
| 5,312,284 | A | 5/1994 | Grober et al. |
| D352,529 | S | 11/1994 | Ho |
| D358,421 | S | 5/1995 | Chow et al. |
| D411,863 | S | 7/1999 | Chan |
| 6,287,560 | B1 * | 9/2001 | Fujii |

* cited by examiner

*Primary Examiner*—Mark Sager
(74) *Attorney, Agent, or Firm*—Roy A. Ekstrand

(57) ABSTRACT

A game housing supports a liquid crystal display having a plurality of liquid crystal display elements therein together with a processor and sound circuit. A plurality of switches simulating the operations of making cookies are operative upon the game housing. These switches include a simulated cookie batter stirring handle together with a simulated roller. Further, the switches include simulated cookie cutters having different shapes. In operation, the manipulation of the simulated cookie batter stirring element produces display images corresponding thereto. Similarly, manipulation of the roller causes a different image to be displayed. Finally, pressing any of the cookie cutter switches causes the corresponding shapes to be display upon the liquid crystal display.

3 Claims, 3 Drawing Sheets

FIG. 2
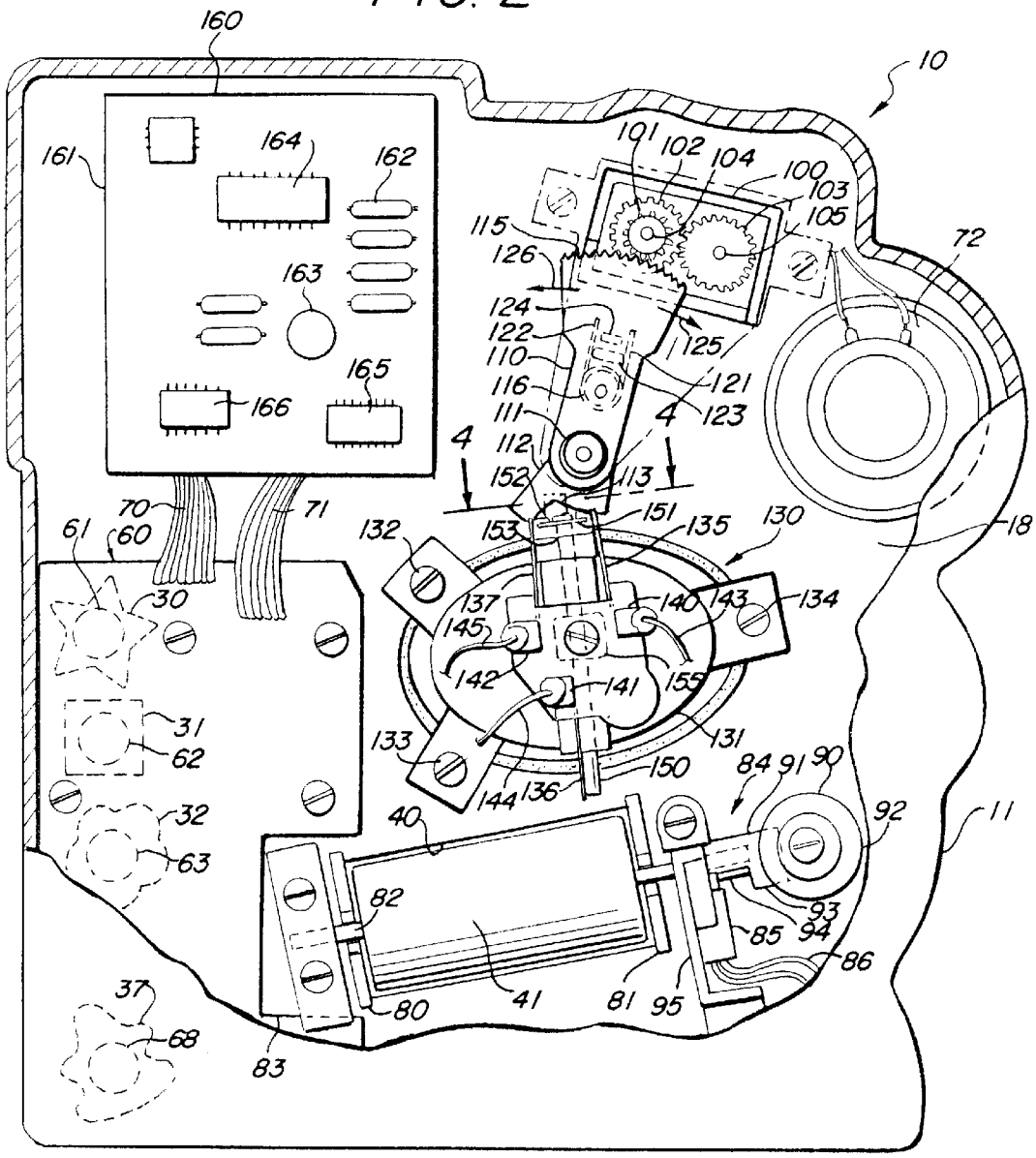
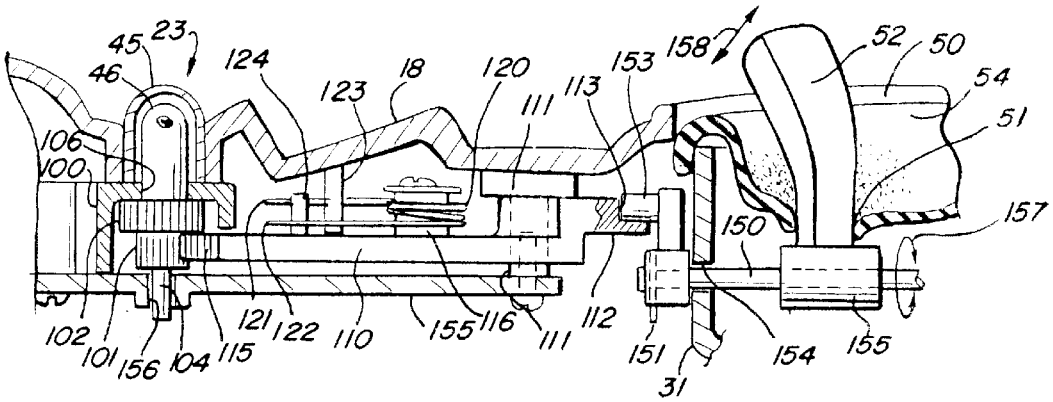
FIG. 3

HANDHELD GAME SIMULATING COOKIE MAKING ACTIVITY

FIELD OF THE INVENTION

This invention relates generally to handheld games and particularly to those mimicking an activity such as cooking or baking.

BACKGROUND OF THE INVENTION

A great variety of toys have been provided by practitioner's in the art for young children which mimic or teach a plurality of activities in attempting to involve the child in game play. Such toys often include lights, sounds and movable elements such as knobs, bells, rollers, levers or the like to add interest and attraction to the game. Still other toys for young children utilize basically non-functional apparatus which is directed toward developing the hand and eye coordination skills of very young children. Such non-functional toys are often referred to in the art as "busy boxes"deriving their name from the basic objective of entertaining and attracting very young children. Typical apparatus found in busy boxes includes rotatable elements such as rollers, twistable elements such as dials or knobs, visual elements such as lights and mirrors, sound elements such as bells or whistles and the like.

With the recent advances in digital electronic systems and particularly to the advances in low-cost microprocessor circuits, digital sound circuits and low-cost displays such as liquid crystal displays, an increasing number of toys for young children have become more functional then previously provided busy box toys or the like. For example, U.S. Pat. No. 4,536,164 issued to Klawitter sets forth a TOY COMPUTER BUSY BOX ASSEMBLY in which a toy assembly is formed to simulate a computer. The toy includes hand manipulated actuating members in a keyboard section connected to image producing members in a screen section. The system utilizes a plurality of gears and levers to produce moving visible images on the screen section.

U.S. Pat. Des. No. 358,421 issued to Chow et al. sets forth an ELECTRONIC EDUCATIONAL ACTIVITY TOY having a table top supported by a plurality of downwardly extending legs. The tabletop in turn supports a plurality of movable elements and buttons which are interactively operated by electronic sound and light means.

U.S. Pat. No. 5,312,284 issued to Grober et al. sets forth an INCREMENTALLY MOVED CYLINDRICAL LENS DISPLAY SYSTEM FOR TOY having a toy computer utilizing a keyboard and a simulated monitor pivotally secured by a hinge coupler. A depressible keyboard unit is pivotally supported by the keyboard and is coupled to a movable slider within the interior of the keyboard housing. A return spring is coupled to the slider and is operative to pivot the slider such that a ratchet engaging tooth is raised to engagement between keyboard strokes. An endless belt display utilizes a cylindrical lens element array together with a segmented image formed on the endless belt to provide apparent motion of the image as the endless belt is moved.

U.S. Pat. No. 4,385,762 issued to Schwartz sets forth an ELECTRONIC MATCHING AND INFORMATION ASSOCIATION GAME having a base supporting a plurality of pieces defining different outlines or otherwise differently configured. Each piece is engageable with an individual location on the playing surface of the game unit base. A set of display elements each associated with one of the locations is activated to indicate visibly when a piece is engaged with its associated location. An electrical operating circuit activates the display elements successfully when the correct piece is engaged with its corresponding location.

U.S. Pat. Des. No. 260,023 issued to Pagni et al. sets forth an ELECTRONIC GAME CASING HAVING A CYLINDRICAL BASE SUPPORTING AN UPWARDLY OPEN HEMISPHERICAL HOUSING a plurality of differently shaped buttons are supported on the face together with electronic means for playing a game.

U.S. Patent Des. No. 321,215 issued to Shamis sets forth an ELECTRONIC TOY having a generally rectangular housing supporting a plurality of depressible buttons. Each of the buttons further supports an icon corresponding to a different basic shape such as triangle, circle, star and the like.

U.S. Patent Des. No. 333 060 issued to Perego sets forth a COMBINED HIGHCHAIR TRAY AND ACTIVITY TOY having a game unit securable to a conventional tray of the type used on highchairs or the like. The game unit supports a simulated telephone together with a plurality of movable buttons and levers.

U.S. Pat. Des. No. 352,529 issued. to Ho sets forth a JOYSTICK having an electronic game housed within a generally planar housing. The upper surface of the game unit housing supports a plurality of buttons and dials together with a vertically extending joystick. The joystick includes a round knob at the upper end thereof.

U.S. Patent Des. No. 411,863 issued to Chan sets forth an HAND-HELD ELECTRONIC GAME having a housing supporting a plurality of knobs and buttons together with a pair of side grips. The housing further supports a plurality of upper buttons and a generally rectangular display screen.

While the foregoing described prior art devices have to some extend improved the art and have in some instances enjoyed commercial success, there remains nonetheless a continuing need in the art for ever more improved, interesting and amusing handheld games.

SUMMARY OF THE INVENTION

Accordingly, it is a general object of the present invention to provided an improved handheld game. It is a more particular object of the present invention to provide and improved handheld game simulating a cookie making activity.

In accordance with the present invention there is provided a game for simulating the making of cookies, the game comprising: a housing having an upper surface defining a plurality of cookie cutter apertures, a roller aperture and a batter bowl image having a handle aperture therein; a roller rotatably supported by the housing and partially extending through the roller aperture and a roller switch actuated by the roller; a plurality of cookie cutter buttons each supported in one of the cookie cutter apertures and a corresponding plurality of cookie cutter switches each actuated by one of the cookie cutter buttons; a handle movably supported in the handle aperture and a stirring switch supported by the housing actuated by movement of the handle; a display screen supported on the upper surface for displaying images thereon; and a control circuit having a display driver for forming images on the display screen having inputs coupled to the roller switch, the plurality of cookie cutter switches and the handle switch, the control circuit, the display driver and the display screen cooperating to form an image on the display screen each time one of the switches is actuated.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 2 sets forth a partially section rear view of the present invention handheld game;

FIG. 3 sets forth a partial section view of the present invention handheld game of FIG. 1 taken along section lines 3—3 therein;

DESCRIPTION OF THE PREFERRED EMBODIMENTS

Figure 1:
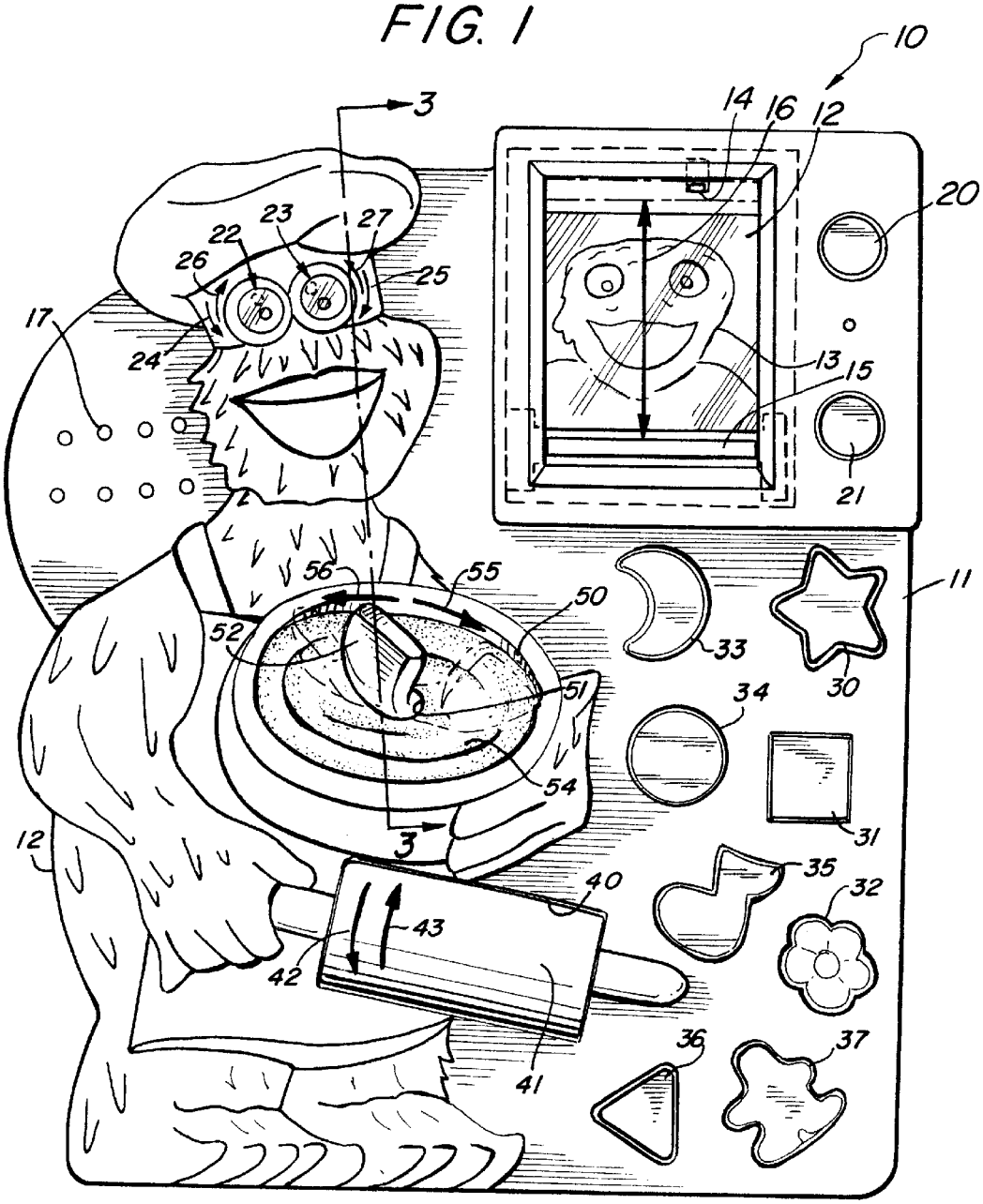
FIG. 1 sets forth front view of a handheld game constructed in accordance with the present invention.

FIG. 1 sets forth a handheld,game constructed in accordance with the present invention and generally referenced by numeral 10. Game 10 includes a housing 11 supporting a FIG. 12 having a pair of movable eyes 22 and 23. Game 10 further includes a display 12 having a slider 15 movable upwardly and downwardly thereon in the directions indicated by arrows 16. A switch 14 is supported at the upper portion of display 12 and is actuated each time slider 15 is raised to the upper most position of its slide travel. Display 12 is preferably fabricated in accordance with conventional fabrication techniques such as a liquid crystal display or the like. The important aspect with respect to the fabrication of display 12 is its ability to form a variety of images such as image 13 shown thereon. Game 10 further includes an on/off button 20 and a start button 21.

In accordance with the present invention, FIG. 12 is shown holding a mixing bowl 50 within which a quantity of cookie batter 54 is simulated. In further accordance with the cooking baking theme of game 10, FIG. 12 is also shown holding a cylindrical roller 41. Roller 41 is supported in a rotatable fashion by means set forth below in FIG. 2. Housing 11 defines a rectangular aperture 40 which allows a portion of roller 41 to be exposed therethrough and to be accessible to the child user. Accordingly, roller 41 may be rotated in the directions indicated by arrows 42 and 43.

In further accordance with the present invention, simulated batter 54 defines an aperture 51 which receives a handle 52. Handle 52 is supported in the manner set forth below in FIG. 3. However, suffice it to note here that handle 52 maybe pivoted about aperture 51 in the directions indicated by arrows 55 and 56 to simulate the stirring or beating of batter 54. Thus, the user grips handle 52 and moves it in the directions by arrows 55 and 56.

By means set forth below in FIG. 3 in greater detail, the movement of handle 52 causes eyes 22 and 23 to move. Thus, as the user moves handle 52 in the direction indicated by arrow 55, eyes 22 and 23 are moved in the directions indicated by arrows 24 and 25. Conversely, as the user uses handle 52 in the direction indicated by arrow 56, eyes 22 and 23 are moved in the directions indicated by arrows 27.

In further accordance with the present invention, housing 11 supports a plurality of "cookie cutter" buttons 30, 31, 32, 33, 34, 35, 36 and 37. Each of buttons 30 through 37 is depressible by the user upon housing 11.

In accordance with the anticipated game play of game 10, the user is able to mimic the process of producing and baking cookies. Accordingly, as the user initially manipulates handle 52, image 13 shows a corresponding cookie batter mixing process taking place. Concurrently, by means set forth below in greater detail, eyes 22 and 23 rapidly oscillate as handle 52 is moved back and forth in the directions mimicking the stirring of simulated cookie batter 54.

Once the simulated cookie batter is properly mixed, the user is then prompted to rotate roller 41 to mimic the action of rolling out the mixed cookie dough. Once again, image 13 responds by means set forth below in greater detail, to the user's movement of roller 41 by displaying an image mimicking or depicting a roller smoothing out a quantity of cookie dough.

Once the cookie dough has been fully rolled, the user is then able to select the shapes of cookies to be cut therefrom by depressing selected ones of cookie cutter buttons 30 through 37. Once again in accordance with the present invention, the controller apparatus within game 10 described below converts image 13 upon display 12 to resemble the shapes of cookies being cut as each of buttons 30 through 37 is depressed by the user.

Once the simulated cookies have been cut to the desired shapes, they are then shown within display 12 as an image resembling an oven. In further accordance with the present invention, the movement of slider 15 is intended to simulate opening and closing of an oven door. Accordingly, when the user raises slider 15 to actuate switch 14, the oven is assumed to be open. Conversely, when slider 15 is not actuating switch 14, the simulated oven shown on display 12 is assumed to be closed.

In this manner, the user is able to move through the basic steps of baking cookies in an interesting and novel manner. The control circuit within housing 11 (seen in FIG. 6) includes a stored set of game rules and instructions by which various responses and prompts are provided to the user to further stimulate and add enjoyment to game play.

FIG. 2 sets forth a partially sectioned rear view of handheld game 10 showing the operative mechanisms within housing 11. Thus, as described above, game 10 includes housing 11 which will be understood to be preferably formed of a molded plastic material or the like.

Game 10 includes a pair of bearings 80 and 81 which receive a rotatable shaft 82. Housing 11 defines an upper side 18 which defines a rectangular aperture 40 extending between bearings 80 and 81. Shaft 82 rotatably supports roller 41 which is positioned by the location of bearings 80 and 81 to extend partially through aperture 40 as shown in FIG. 1. A bracket 95 supports a micro switch 85 in close proximity to one end of shaft 82. Shaft 82 further supports a cam 91 having a spring lobe 93 and a switch lobe 94 formed thereon. A spring 90 supports a flange 92 above spring lobe 93. Thus, as the user rotates roller 41, cam 91 is correspondingly rotated causing spring lobe 93 to rotate against flange 92 and causing switch lobe 94 to rotate against micro switch 85. As a result, the rotation of roller 41 in either direction causes micro switch 85 to be repeatedly activated as switch lobe 94 presses and releases the micro switch. Spring lobe 93 cooperates with spring 90 to ensure that each time the user ceases rotating roller 41, cam 91 is pivoted away from micro switch 885. In essence, spring 90 and flange 92 force spring lobe 93 to rotate downwardly causing switch lobe 94 to rotate from micro switch 85. This avoids having micro switch 85 continuously in a closed position.

Game 10 further includes a switch assembly 60 fabricated in accordance with conventional fabrication techniques, and having a plurality of pressure actuated switches such as switches 61, 62, 63 and 68. For purposes of illustration, switches 61, 62, 63 and 68 are shown in alignment with their respective cookie cutter buttons 30, 31, 32 and 37. Returning temporarily to FIG. 1, it will be noted that housing 11 supports a plurality of cookie cutter buttons 30 through 37. Returning to FIG. 2, it will be understood that switch assembly 60 supports a corresponding plurality of pressure actuated switches one for each of cookie cutter buttons 30 through 37 (seen in FIG. 1).

Game 10 further includes a sound and control circuit 160 having a printed circuit board 161 supporting a plurality of electronic components such as components 162 and 163. Sound and control circuit 160 is fabricated in accordance with conventional fabrication techniques, and corresponds to the block diagram set forth below in FIG. 6. Suffice it to note here, that sound and control circuit 160 includes a microprocessor 165 having an associated memory 166. Sound and control circuit 160 further includes a display drive 167 coupled to microprocessor 165 and a sound circuit 164 also operatively coupled to microprocessor 165. A plurality of connecting wires 70 and 71 operatively couple sound and control circuit 160 to switch assembly 60 and micro switch 85. In addition, wires 71 are operatively coupled to switch assembly 130 and speaker 72. To avoid unduly cluttering the figure, the actual connections between wires 71 and switch assembly 130, speaker 72 and micro switch 85 are not shown. In addition, game 10 includes a plurality of conventional batteries (not seen in the section view of FIG. 2) which will be understood to be operatively coupled to sound and control circuit 160.

Game 10 further includes a switch assembly 130, which is operatively coupled to handle 52 (seen in FIG. 1). Switch assembly 130 includes a housing 131 secured to upper side 18 of housing 11 by a plurality of conventional fasteners 132, 133 and 134. Housing 131 supports an elongated shaft 150 extending through housing 131 in the manner shown in FIG. 3. Switch assembly 130 includes a terminal 141 coupled to connecting wires 71 by a wire 144. Terminal 141 is joined to a contact 136 which in turn rubs against shaft 150. Shaft 150 supports a toggle 152 at the opposite end thereof which in turn supports a contact 151. Contact 151 is electrically connected to terminal 141 by shaft 150 and contact 136. Toggle 152 includes a downwardly extending post 153.

Switch assembly 130 further includes a terminal 142 having a connecting wire 145 coupling it to connecting wires 71. Terminal 142 is joined to a contact 137 which extends forwardly along one side of toggle 152. Switch assembly 130 further includes a terminal 140 having a connecting wire 143 coupled to connecting wires 71. Terminal 140 further includes a forwardly extending contact 135 which is positioned on the remaining side of toggle 152.

Game 10 further includes a gear box 100 within which a pair of rotatable shafts 104 and 105 are rotatably supported. Shaft 105 supports a gear 103 while shaft 104 supports a compound gear pair 101 and 102. A lever 110 includes an arm 112 having a notch 113 receiving a portion of post 153 of toggle 152. Lever 110 is pivotally supported by a pivot 111. A post 116 is supported upon lever 110 and a spring 120 is received thereon. Spring 120 includes a pair of spaced apart spring ends 121 and 122. A tab 123 extends downwardly from upper side 18 of housing 11 between spring ends 121 and 122. A tab 124 extends from lever 110 in the manner seen in FIG. 3, and is also positioned between spring ends 121 and 122. Lever 110 further includes a gear sector 115 which includes a plurality of gear teeth engaging gear 101 within gear box 100. As is better seen in FIG. 3, gear 102 is coupled to eye 23. In a similar fashion, gear 103 is coupled to eye 22 (seen in FIG. 1). A speaker 72 is supported within housing 11 and is positioned against speaker grille 17 (seen in FIG. 1).

In operation, the child user is able to manipulate the apparatus shown in FIG. 1 in an attempt to mimic the activity of making cookies described above in FIG. 1. Thus, as the user manipulates handle 52 (seen in FIG. 1) to imitate the process of stirring cookie batter, shaft 150 is pivoted back-and-forth which in turn pivots toggle 152, post 153 and contact 151. The operation of switch assembly 130 is set forth below in FIGS. 4 and 5 in greater detail. However, suffice it to note here, that the manipulation of handle 52 pivots toggle 152 and contact 151 such that contact 151 is moved back-and-forth between touching contact 137 and contact 135. This produces a series of electrical signals which are coupled to sound and control circuit 160. Sound and control circuit 160 responds to the identifiable signals produced in this manner by switch assembly 130 in response to manipulation to handle 52 (seen in FIG. 1) to cause a corresponding image to be formed on display 12 (seen in FIG. 1).

In addition, the movement of toggle 152 and post 153, pivots lever 110 about pivot 111 in the directions indicated by arrows 125 and 126. This movement overcomes the force of spring 120 which would otherwise center lever 110 in alignment with tabs 123 and 124. Thus, each movement in either direction as indicated by arrows 125 and 126 is followed by a return to center due to spring 120. More importantly, the movement of lever 110 in the directions indicated by arrows 125 and 126 moves gear sector 115 in a manner pivoting gears 101 and 102 back-and-forth about shaft 104. As mentioned above, the movement of gear 102 produces a corresponding pivotal movement of eye 23. In addition, the engagement of gear 102 and gear 103 causes this rotation of gear 102 to pivot gear 103 about shaft 105 which in turn produces pivotal movement of eye 22 (seen in FIG. 1).

Thus, as the user moves handle 52 in the above described stirring action, switch assembly 130 produces electrical signals which sound and control circuit 160 use to form an appropriate display while lever 110 and gears 101 through 103 within gear box 100 cause eyes 22 and 23 (seen, in FIG. 1) to undergo pivotal movement.

When the user continues the above described game play and manipulates roller 41, the rotation of roller 41 produces a corresponding rotation of shaft 82 which in turn rotates cam 91 actuating micro switch 85. The actuation as switch lobe 94 activates micro switch 85 produces an identifying electronic signal which is coupled by wires 86 to sound and control circuit 160. Once again, sound and control circuit 160 responds to the activation of micro switch 85 to produce an image on display 12 (seen in FIG. 1) corresponding to the rolling of cookie dough.

Once the user has finished the rolling process the user then in the above game play scenario pressing one or more of cookie cutter buttons 30 through 37 (seen in FIG. 1). If for example, the user pushes cookie cutter button 30, switch 61 of switch assembly 60 is activated producing a signal condition which is communicated to sound and control circuit 160 causing the sound and control circuit to produce an image on display 12 (seen in FIG. 1) corresponding to the shape of cookie cutter button 30. This process continues as other cookie cutter buttons are pressed actuating their respective pressure responsive switches to produce respective input signals to processor 165 of sound and control circuit 160. As a result, a series of displayed images are formed on display 12 (seen in FIG. 1) corresponding in shape to the cookie cutter buttons.

Sound and control circuit 160 is set forth below in FIG. 6 in block diagram form. Suffice it to note here, that sound and control circuit 160 operates in accordance with conventional fabrication techniques and utilizes a conventional microprocessor 165 having an associated memory 166. Memory 166 stores a plurality of program instructions which configure processor 165 to carry forward the various control functions for appropriate image display in response to switch actuation of so on. In addition, sound and control circuit 160 includes a display driver 167 which converts the output signals of processor 165 to appropriate signals to configure the display elements of liquid crystal display 12 (seen in FIG. 6). Finally, sound and control circuit 160 includes a conventional integrated circuit sound device 164. Sound device 164 responds to processor 165 to produce audible output signals which are applied to speaker 72 to provide various sounds such as game prompts or the like for the amusement of the user. It will be recognized that sound circuit 164 may be fabricated entirely in accordance with conventional fabrication techniques.

FIG. 3 sets forth a partial section view of game 10 taken along section lines 3—3 in FIG. 1. As described above, housing 11 includes an upper side 18 which supports a bowl 50 having a simulated cookie batter portion 54 therein. Batter portion 54 defines an aperture 51 which receives a handle 52. As is also described above, game 10 includes a housing 31 secured to batter portion 54 and upper side 18. Housing 31 defines an aperture 154 which receives one end of a shaft 150. Handle 52 is secured to shaft 150 beneath aperture 51 by a collar 155. As a result, movement of handle 52 within aperture 51 in the directions indicated by arrows 158 produces a corresponding pivotal movement of shaft 150 in the manner 7 indicated by arrows 157. Shaft 150 further supports a toggle 152 having a contact 151 supported thereby. Toggle 152 extends upwardly from shaft 150 and supports a laterally extending post 153.

A pivot 111 is secured to the under surface of upper side 18 supports a lever 110. Lever 110 includes an arm 112 having a notch 113 formed therein. Post 153 is received within notch 113. Lever 11 further supports a gear sector 115 and a post 116. Post 116 receives and supports a spring 120 having spaced apart spring ends 121 and 122. A tab 124 extends downwardly between spring ends 121 and 122 from upper side 18 while a tab 124 extends upwardly from lever 110. Spring ends 121 and 122 cooperate with tabs 123 and 124 to provide spring forces which return lever 110 to its centered position in the absence of movement by toggle 152.

Game 10 further includes a gear box 100 having an aperture 106 formed therein. A frame 155 is secured to pivot 111 and is further supported upon upper side 18 by conventional fasteners. Frame 155 defines an aperture 156 which receives a rotatable shaft 104. Shaft 104 extends upwardly through gear box 100 and is secured to an upwardly extending eyepiece 46. Eye piece 46 receives the upper end of shaft 104 and passes through aperture 106 of gear box 100. While not seen in FIG. 3, it will be understood that eye 22 (seen in FIG. 1) is fabricated in the same manner as eye piece 46 and gear 102. A transparent eye dome 145 is supported upon gear box 100 and encloses eye piece 46. The combined structure of eye dome 45 and eye piece 46 form eye 23. Eye piece 46 is joined to a gear 102 which in turn is joined to a gear 101. As is set forth above in FIG. 2, gear 102 engages 103 which supports a corresponding eye piece within eye 22 (seen in FIG. 1). Gear sector 115 engages 101. In operation, as the user manipulates handle 52 in the direction indicated by arrow 158 to simulate stirring of cookie batter, shaft 1506 is pivoted back-and-forth in the manner indicated by arrows 157 which in turn pivots toggle,152 moving post 153 back-and-forth. The engagement of post 153 within notch 113 and the placement of pivot 111 result in producing pivotal movement of lever 110 against spring 120 in a back-and-forth manner which in turn pivots gear 101 and gears 102 and 103 (gear 103 seen in FIG. 2). The back-and-forth pivoting movement of gears 102 and 103 in turn pivots the eye pieces of eyes 22 and 23 (seen in FIG. 1).

Figure 4:
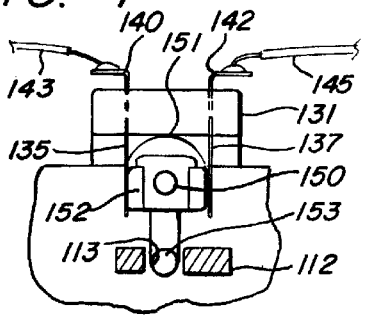
FIG. 4 sets forth a partial section view of the handheld game of FIG. 2 taken along section lines 4—4 therein.
Figure 5:
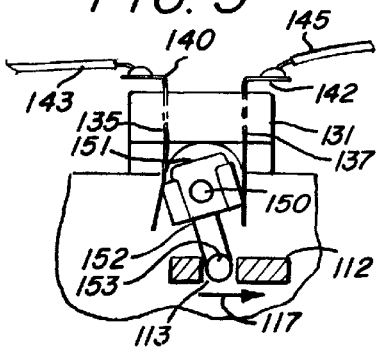
FIG. 5 sets forth the section view of FIG. 4 illustrating an alternate position of the switch mechanism therein.

FIG. 4 sets forth a partial section view of game 10 taken along section lines 4—4 in FIG. 2. By way of overview, FIGS. 4 and 5 show the same section view of game 10 with the difference being found in the position of arm 112. In FIG. 4, arm 112 is at rest while, in FIG. 5, arm 112 has moved laterally as handle 52 (seen in FIG. 1) is manipulated.

More specifically, switch assembly 130 includes a switch 131 having a pair of terminals 140 and 142 coupled to a pair of connecting wires 143 and 145. A pair of contacts 135 and 137 are connected to terminals 140 and 142 respectively. A toggle 152 formed of a nonconductive material includes a post 153 received within notch 113 of arm 112. Toggle 152 further supports a contact 151.

In the position shown in FIG. 4, toggle 152 is at rest and corresponds to the position which handle 52 (seen in FIG. 1) places arm 112 in the absence of movement of handle 52. In this position, the nonconductive material such as molded plastic or the like from which toggle 152 is formed separates or insulates contact 151 from either of contacts 135 or 137. As a result, no input signal is provided indicative of a cookie batter stirring activity.

FIG. 5 sets forth the section view of FIG. 4 in which toggle 152 assumes the position resulting from movement of handle 52 (seen in FIG. 1).

More specifically, switch assembly 130 includes a switch 131 having a pair of terminals 140 and 142 coupled to a pair of connecting wires 143 and 145. A pair of contacts 135 and 137 are connected to terminals 140 and 142 respectively. A toggle 152 formed of a nonconductive material includes a post 153 received within notch 113 of arm 112. Toggle 152 further supports a contact 451. In the position shown in FIG. 5, handle 52 (seen in FIG. 1) has been moved causing arm 112 to be moved in the direction indicated by arrow 117. This movement of arm 112 causes a pivoting of toggle 152 about shaft 150. The pivoting movement of toggle 152 brings contact 151 into contact with contact 135. This completes an electrical connection through switch assembly 130 to terminal 140 and connecting wire 143.

Figure 6:
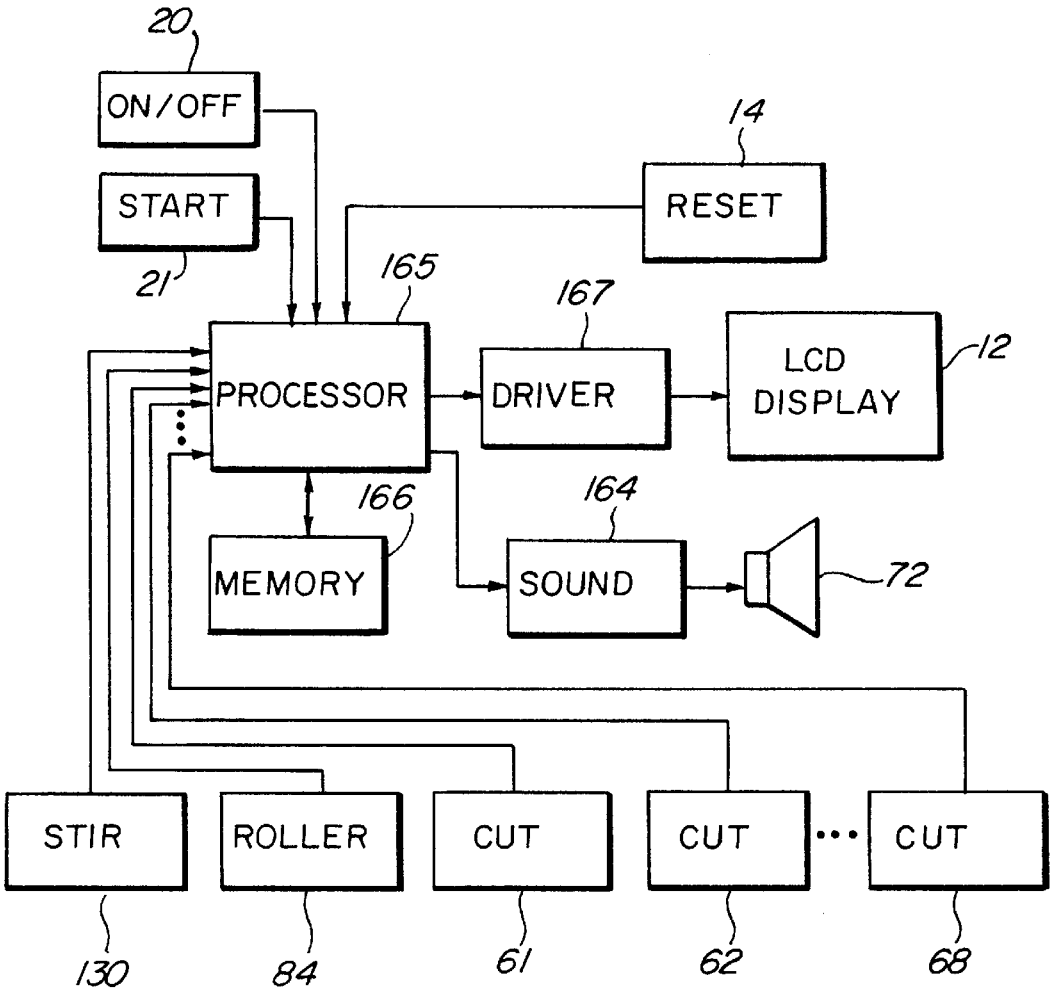
FIG. 6 sets forth a block diagram of the control and sound circuit operative within the present invention handheld game.

FIG. 6 sets forth a block diagram of sound and control circuit 160. Circuit 160 is fabricated in accordance with conventional fabrication techniques and includes a processor 165 coupled to a start switch 21 and an on/off switch 20. In addition, a reset switch 14 is coupled to processor 165. A plurality of switches are further coupled to processor 165 which are utilized in the above-described play pattern. A stirring switch 130 is coupled to one input of processor 165. Similarly, a roller switch 84 and a plurality of cookie cutting switches 61 through 68 are also operatively coupled to processor 165. Processor 165 includes an associate memory 166within which a Stored instruction set provides the game activity and causes processor 165 to play the above-described game. A display driver 167 is controlled by processor 165 and is operative to convert the display signal data outputted by processor 165 into appropriate signals which configure a liquid crystal display 12.

A sound circuit 164 constructed in accordance with conventional fabrication techniques responds to control signals from processor 165 to produce audible sound signals applied to a speaker 72.

Thus, each time'switch 130 is actuated, a signal is applied to processor 165 causing driver 167 to configure display 12 accordingly. Simultaneously, processor 165 in response to the stored instruction set within memory 166 outputs appropriate digital sound signals to sound circuit 164 which in turn produces audible signals corresponding thereto for energizing speaker 72. Similar operations take place in response to cookie cutter switches 61 through 68 and roller switch 84. Reset button 14 operates in the manner seen in FIG. 1 in response tithe movement of slider 15 and, in effect, provides the appearance of an opening and closing oven door by display erasing liquid crystal display 12.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A handheld game for simulating the making of cookies, said game comprising:

a housing having an upper surface defining a figure representing a baker and having movable eyes, a plurality of cookie cutter apertures, a roller aperture and a batter bowl image having a handle aperture therein;

a roller rotatably supported by said housing and partially extending through said roller aperture and a roller switch actuated by said roller;

a plurality of cookie cutter buttons each supported in one of said cookie cutter apertures and a corresponding plurality of cookie cutter switches each actuated by one of said cookie cutter buttons;

a handle movably supported in said handle aperture and a stirring switch supported by said housing actuated by movement of said handle;

eye movement means within said housing for moving said movable eyes in response to movement of said handle;

a display screen supported on said upper surface for displaying images thereon; and a control circuit having a display driver for forming images on said display screen having inputs coupled to said roller switch, said plurality of cookie cutter switches and said handle switch, said control circuit, said display driver and said display screen cooperating to form an image on said display screen each time one of said switches is actuated.

2. The game set forth in claim 1 wherein said control circuit includes a microprocessor and cooperating memory having a stored game play instruction set therein.

3. The game set forth in claim 2 wherein said control circuit further includes a sound circuit and wherein said housing further supports a speaker operatively coupled to said housing.

* * * * *